US009363588B2

(12) United States Patent
Wang et al.

(10) Patent No.: US 9,363,588 B2
(45) Date of Patent: Jun. 7, 2016

(54) PANEL-FORM LOUDSPEAKER

(71) Applicants: Hongxing Wang, Shenzhen (CN); Rongguan Zhou, Shenzhen (CN); Lubin Mao, Shenzhen (CN)

(72) Inventors: Hongxing Wang, Shenzhen (CN); Rongguan Zhou, Shenzhen (CN); Lubin Mao, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/339,562

(22) Filed: Jul. 24, 2014

(65) Prior Publication Data

US 2015/0117679 A1 Apr. 30, 2015

(30) Foreign Application Priority Data

Oct. 28, 2013 (CN) ..... 2013 2 0668046 U

(51) Int. Cl.
*H04R 25/00* (2006.01)
*H04R 1/02* (2006.01)
*H04R 7/04* (2006.01)

(52) U.S. Cl.
CPC ..... *H04R 1/02* (2013.01); *H04R 7/045* (2013.01); *H04R 2499/11* (2013.01)

(58) Field of Classification Search
CPC ..... H04R 1/02; H04R 17/00; H04R 17/005; H04R 2400/01; H04R 2400/03; H04R 2400/07; H04R 2499/11
USPC ..... 381/162, 345, 349, 351, 182, 190, 191, 381/396
See application file for complete search history.

(56) References Cited

U.S. PATENT DOCUMENTS 8,189,841 B2 * 5/2012 Litovsky ..... H04R 1/2834 381/182
8,233,646 B2 * 7/2012 Lutz ..... H04R 7/18 381/150

* cited by examiner

*Primary Examiner* — Sunita Joshi
(74) *Attorney, Agent, or Firm* — IPro, PLLC; Na Xu

(57) ABSTRACT

A panel-form loudspeaker is disclosed. The panel-form loudspeaker includes a cover having a bottom forming an opening in a middle portion thereof; a vibration plate at least partially accommodated in the opening; an actuator fixed with the cover and engaging with the vibration plate for driving the vibration plate to vibrate; a gap formed between the vibration plate and the bottom of the cover; and a suspension. The vibration plate includes an inner surface and an outer surface opposite to the inner surface. The suspension includes a first connecting portion connecting with the inner surface of the vibration plate, and a second connecting portion connecting with a top of the bottom for suspending the vibration plate in the opening.

8 Claims, 4 Drawing Sheets

PANEL-FORM LOUDSPEAKER

FIELD OF THE INVENTION

The present invention relates to a speaker apparatus, and particularly, to a panel-form loudspeaker for an electronic device using a back cover of the device as a vibration plate.

DESCRIPTION OF RELATED ART

Development of communication technologies and increase in users' requirements have recently enabled mobile communication terminals to provide multimedia functions such as music, videos, games, and the like in addition to the typical calling function. In order to provide these and other multimedia functions, the terminal is equipped with a highly functional loudspeaker independently of a typical receiver speaker. The loudspeaker includes one or two circular speakers with a diameter of approximately 10~15 mm, and is generally mounted in a case or in a hinge unit in case of a folder-type terminal. Generally, this kind of loudspeaker includes a membrane driven by a voice coil. However, the size of the loud speaker is limited, typically to the diameter of 10~15 mm. As a result, the frequency response of the loud speaker is also limited, especially in a frequency region under 700 Hz (low sound). As the vibration plate of the speaker becomes smaller, the reproducing frequency response characteristic is moved toward higher frequencies. Lower frequency characteristics may be enhanced by installing speakers with larger diameters, but this option is limited due to the devices themselves getting smaller and smaller.

For solving the problems mentioned above, a panel-form loudspeaker using the display of a mobile device to generate sounds is developed. This kind of loudspeaker generally includes a display and an actuator driving the display to vibrate, by which audible sounds with low frequency is accordingly generated. Compared with the conventional speaker, membrane and voice coil are displaced by the display and the actuator. The display includes a glass plate on the most top thereof and the glass plate is easy to be broken by the vibration of the actuator. Further, it is too difficult to improve the sound performance generated by the display because the display cannot be adjusted once the display is fixed.

Accordingly, an improved panel-form loudspeaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

In an embodiment of the present invention, a panel-form loudspeaker is provided for a mobile communication terminal capable of effectively reproducing sound in a low frequency region by using a vibration plate connected with a back cover or a front cover of the terminal. While a mobile communication terminal is discussed for simplicity, the embodiment of the invention are capable of being applied to any type of mobile devices, for example PDAs, mobile phones, tablets, notebooks, and MP3 players, where it is preferred to keep the overall dimensions of the mobile devices themselves to a minimum.

Figure 1:
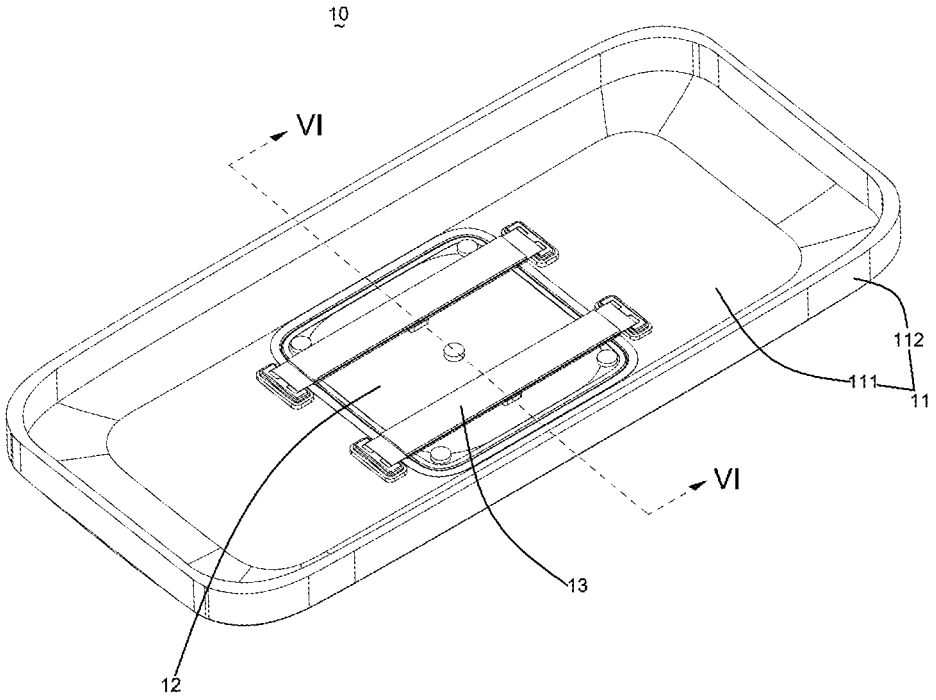
FIG. 1 is an illustrative isometric view of a panel-from loudspeaker in accordance with an exemplary embodiment of the present disclosure.
Figure 2:
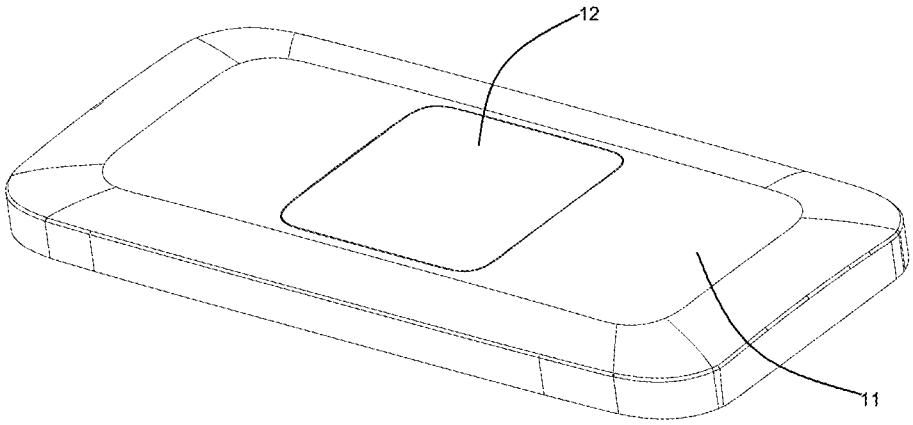
FIG. 2 is an illustrative isometric view of the panel-from loudspeaker in FIG. 1, from another aspect.

Referring to FIGS. 1-2, a panel-form loudspeaker 10 in accordance with an exemplary embodiment of the present disclosure comprises a cover 11, a vibration plate 12 assembled with the cover 11, and at least one actuator 13 fixed with the cover 11 and engaging with the vibration plate 12. The cover 11 may be a back cover of an electronic device, or a front cover, even a display screen of the device. The vibration plate 12 can be regarded as a part of the cover. In this embodiment, the vibration plate 12 is separated from but connected with the cover 11. The cover 11 comprises a bottom 111 and a sidewall 112 extending from an edge of the bottom 111. The sidewall 112 is actually an optional element to form the cover 11. In fact, in many cases, the cover 11 only includes a bottom 111.

Figure 3:
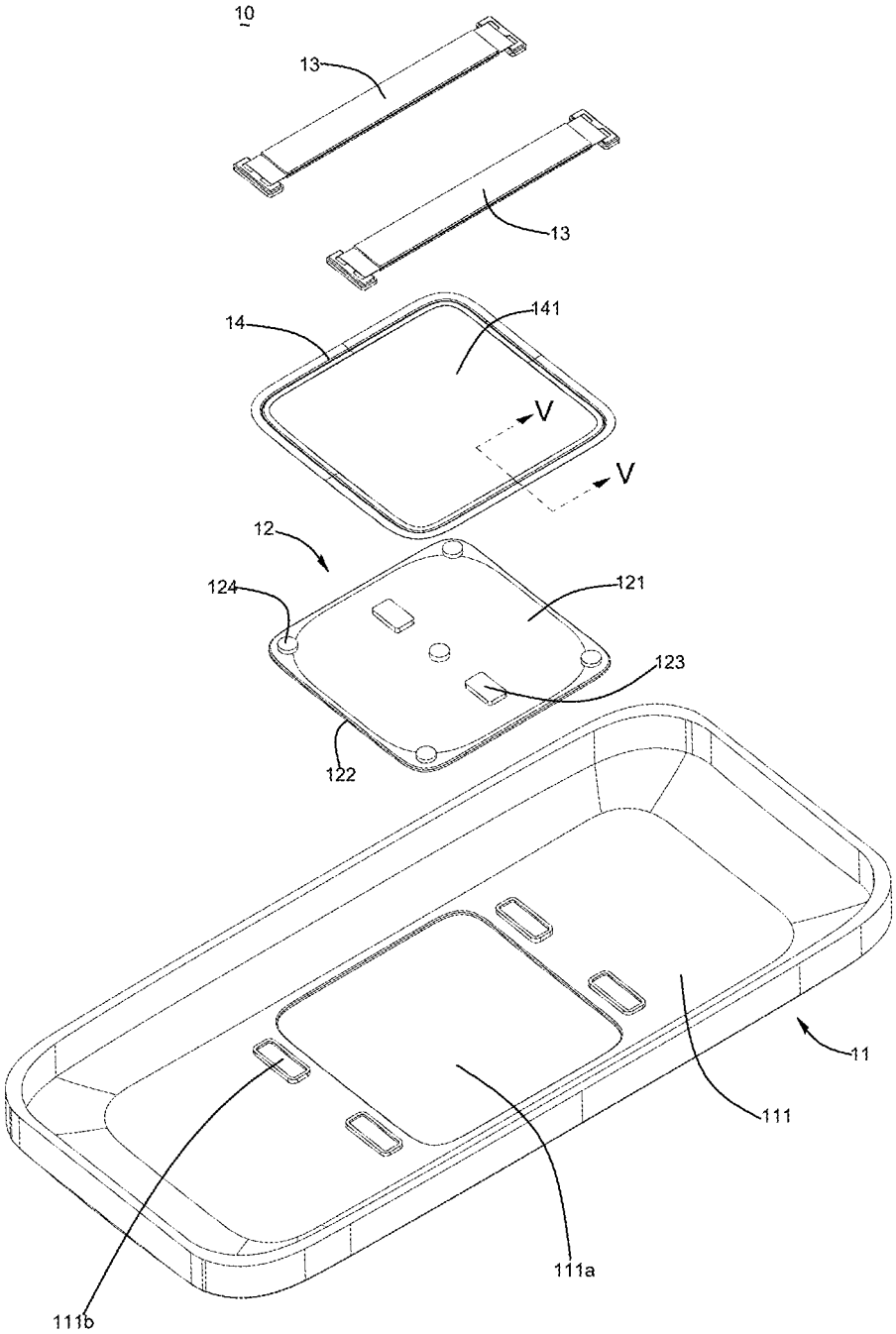
FIG. 3 is an exploded view of the panel-from loudspeaker in FIG. 1.

Referring to FIG. 3 which is an exploded view of the panel-form loudspeaker 10, the cover 11 forms an opening 111*a* in the bottom 111 for accommodating the vibration plate 12. A plurality of fixing portions 111*b* is arranged on the bottom 111 around the opening 111*a*. The vibration plate 12 includes an inner surface 121 and an outer surface 122 opposite to the inner surface 121. Further, the vibration plate 12 includes at least one protrusion 123 corresponding to the at least one actuator 13. Besides, the vibration plate 12 comprises a plurality of pillars 124 arranged on the inner surface 121. Shape of the vibration plate 12 is consistent with that of the opening 111*a* of the cover 11.

The panel-form loudspeaker 10 further includes a suspension 14 for assembling the vibration plate 12 to the cover 11. The suspension 14 has a shape of ring and forms a through hole 141 in a middle portion thereof. In this embodiment, a pair of actuators 13 is provided. Alternatively, only one actuator 13 is also possible to drive the vibration plate 12 to vibrate.

Figure 4:
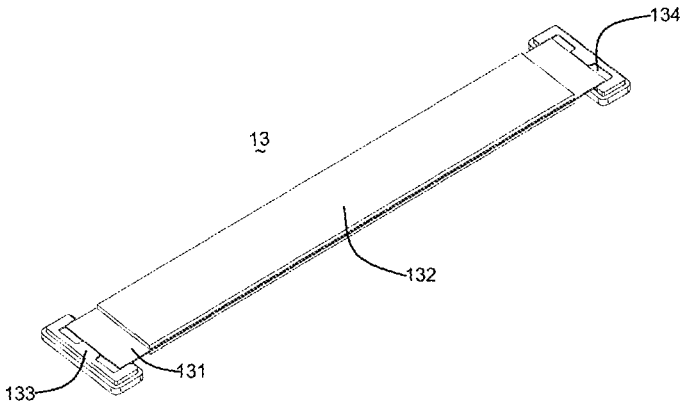
FIG. 4 is an isometric view of an actuator of the panel-form loudspeaker.

Referring to FIG. 4 which is an isometric view of the actuator 13 used in the present invention, the actuator 13 in this embodiment is a piezoelectricity actuator. In fact, in other embodiments, the actuator 13 may be a linear vibrator, or a voice coil motor, or other vibrators. The actuator 13 includes a base plate 131, at least one piezoelectricity plate 132 attached to one surface of the base plate 131. Generally, a pair of piezoelectricity plates 132 is provided for balancing the vibration of the actuator 13. The actuator 13 further includes a pair of positioning portions 133 located on two ends of the base plate 131.

Figure 5:
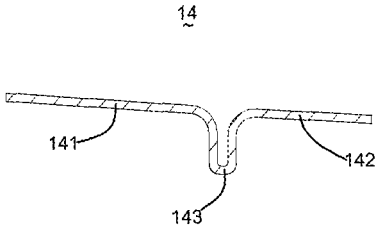
FIG. 5 is a cross-sectional view of a suspension of the panel-form loudspeaker taken along line V-V in FIG. 3.

Referring to FIG. 5, the suspension 14 is formed by a ring and includes a first connecting portion 141, a second connecting portion 142, and a concave portion 143 connecting the first connecting portion 141 to the second connecting portion 142.

Figure 6:
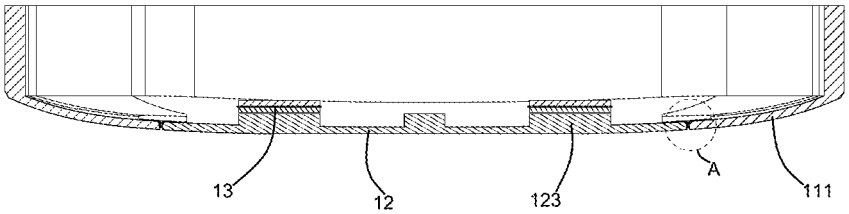
FIG. 6 is a cross-sectional view of the panel-form loudspeaker taken along line VI-VI in FIG. 1

While assembled, referring to FIGS. 1, 3, and 6, the vibration plate 12 accommodates in the opening 111*a* of the cover 11 with the protrusions 123 engaging with the actuators 13. The actuator 13 is positioned on the bottom 111 of the cover 11 with the two positioning portions 133 engaging with the fixing portions 111*b* of the cover 11. The base plate 131 and the piezoelectricity plate 132 cross over the vibration plate 12. The protrusion 123 is used for effectively transmitting the vibration from the actuator 13 to the vibration plate 12. In fact, the actuator 13 can engage with the vibration plate 12 directly, not via the protrusion 123.

Figure 7:
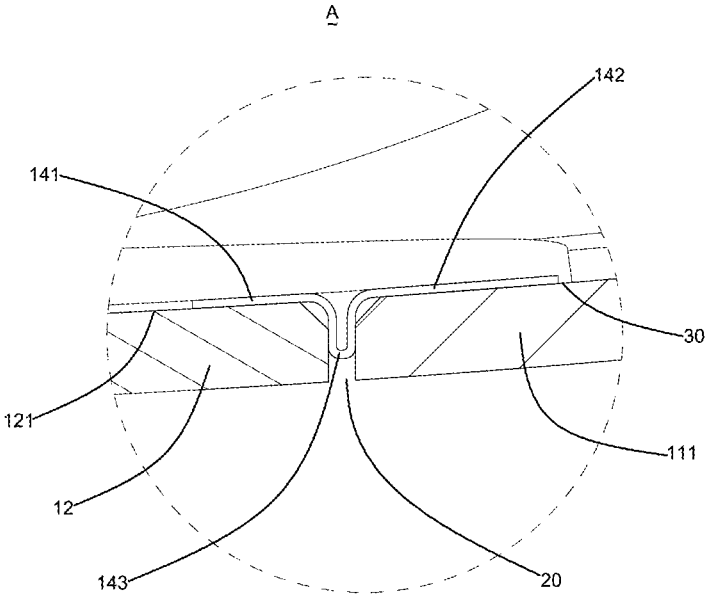
FIG. 7 is an enlarged view of Part A in FIG. 6.

Referring to FIG. 7 which is an enlarged view of Part A in FIG. 6, together with FIG. 3, the vibration plate 12 is connected with the bottom 111 of the cover 11 by the suspension 14. When the vibration plate 12 is assembled in the opening 111*a* of the cover 11, a gap 20 is formed between the vibration plate 12 and the bottom 111 of the cover 11. The first connecting portion 141 of the suspension 14 connects with the inner surface 121 of the vibration plate 12, the second connecting portion 142 connects with a top surface 30 of the bottom 111 of the cover 11, and the concave portion 143 is received in the gap 20, by which the vibration plate 12 is suspended by the suspension 14 and is capable of vibrating relative to the cover 11. When electrified, the actuator 13 vibrates and thus actuates the vibration plate 12 to vibrate by the engagement of the protrusion 123 and the actuator 13. By virtue of the suspension 14, the vibration plate 12 is capable of vibrating in the opening 111*a* for generating audible sounds. The suspension 14 is elastic and capable of suspending the vibration plate 12 elastically. Optionally, the suspension 14 is made of plastic, such as PET (polyethylene terephthalate), or PU (Polyurethane).

The gap 20 between the vibration plate 12 and the bottom 111 of the cover is not more than 0.2 mm for not affecting the appearance of the cover 11. The pillars 124 are used for limiting the amplitude of the vibration plate 12. Referring to FIG. 4 again, the positioning portion 133 of the actuator 13 forms a recess 134 for firmly receiving the end of the base plate 131.

The present disclosure provides a panel-form loudspeaker having a vibration plate separated from but connected with the cover, by which configuration the vibration plate could be adjusted for improving the acoustic performance of the loudspeaker. The vibration plate may be formed by material different from that of the cover, which provides more possibilities to design the cover and tune the sound performance.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A panel-form loudspeaker, comprising:

a cover having a bottom forming an opening in a middle portion thereof;

a vibration plate at least partially accommodated in the opening, the vibration plate including an inner surface and an outer surface opposite to the inner surface;

an actuator fixed with the cover and engaging with the vibration plate for driving the vibration plate to vibrate;

a gap formed between the vibration plate and the bottom of the cover; and a suspension including a first connecting portion connecting with the inner surface of the vibration plate and a second connecting portion connecting with a top of the bottom for suspending the vibration plate in the opening;

wherein the suspension further includes a concave portion connecting the first connecting portion to the second connecting portion; and wherein the concave portion of the suspension is received in the gap between the vibration plate and the bottom of the cover.

2. The panel-form loudspeaker as described in claim 1, wherein the vibration plate further comprises a protrusion on the inner surface corresponding to the actuator for engaging with the actuator.

3. The panel-form loudspeaker as described in claim 1, wherein the vibration plate further includes a plurality of pillars for limiting the amplitude of the vibration plate.

4. The panel-form loudspeaker as described in claim 1, wherein the actuator includes a base plate, at least one piezoelectricity plate attached to the base plate, and a positioning portion connected with the base plate for positioning the actuator on the bottom of the cover.

5. The panel-form loudspeaker as described in claim 4, wherein the positioning portion further includes a recess for fixing the base plate.

6. The panel-form loudspeaker as described in claim 4, wherein the cover further includes a fixing portion corresponding to the positioning portion of the actuator for fixing the actuator.

7. The panel-form loudspeaker as described in claim 1, wherein the suspension is made of plastic.

8. The panel-form loudspeaker as described in claim 7, wherein the suspension is made of polyethylene terephthalate, or PU Polyurethane.

* * * * *